United States Patent [19]

Brown et al.

[11] Patent Number: 4,479,286

[45] Date of Patent: Oct. 30, 1984

[54] APPARATUS TO EXTRACT FINE TRASH AND DUST DURING HIGH-VELOCITY DISCHARGING OF COTTON FROM OPENER CLEANER

[75] Inventors: Roger S. Brown, Clemson, S.C.; Charles L. Shepard, Chlamette; Laurey J. Richard, Metairie, both of La.

[73] Assignee: The United States of America as represented by the Secretary of Agriculture, Washington, D.C.

[21] Appl. No.: 311,702

[22] Filed: Oct. 15, 1981

[51] Int. Cl.[3] ..... D01C 9/08

[52] U.S. Cl. ..... 19/200; 19/107; 19/205; 19/307

[58] Field of Search ..... 19/105, 107, 200, 204, 19/205, 304, 305, 307, 308

[56] References Cited

U.S. PATENT DOCUMENTS

| | | | |
|---|---|---|---|
| 2,926,417 | 3/1960 | Duvall | 19/307 X |
| 3,051,998 | 9/1962 | Rust et al. | 19/307 |
| 3,744,092 | 7/1973 | Auten | 19/307 X |
| 3,766,607 | 10/1973 | Jende et al. | 19/307 |
| 4,135,276 | 1/1979 | Handschuch | 19/105 X |
| 4,274,178 | 6/1981 | Hotta | 19/106 R |
| 4,315,347 | 2/1982 | Austin | 19/105 X |

FOREIGN PATENT DOCUMENTS

| | | | |
|---|---|---|---|
| 496981 | 3/1976 | U.S.S.R. | 19/200 |
| 197706 | 6/1977 | U.S.S.R. | 19/200 |

*Primary Examiner*—Louis Rimrodt
*Attorney, Agent, or Firm*—M. Howard Silverstein; David G. McConnell; Raymond C. Von Bodungen

[57] ABSTRACT

An apparatus to extract cotton dust from the high velocity discharge of a cotton cleaning device is disclosed. Means for reduction and removal of fine trash and dust from cotton fiber is provided. At the high velocity discharge exit is placed a perforated cylinder rotating about an open-end stationary tube with an opening across its width. Fine trash and dust pass through perforations into a low pressure area inside the stationary tube and are discharged through a blower or suction source. Means to remove the cotton fiber to an intake duct from the cleaning device is provided as well as internal and adjustable external baffles.

3 Claims, 2 Drawing Figures

APPARATUS TO EXTRACT FINE TRASH AND DUST DURING HIGH-VELOCITY DISCHARGING OF COTTON FROM OPENER CLEANER

BACKGROUND OF THE INVENTION (1) Field of the Invention

The instant invention relates to an apparatus for improving air quality.

More specifically, the instant invention is an apparatus used to reduce fine trash and dust in a textile processing operation.

(2) Description of the Prior Art

In the prior art one principal objective in the processing of cotton fiber from a bale to a carding machine is to reduce cotton tuft size while the mass of tufts are being opened by fluffing such that large quantities of trash are removed. Inherent in the process of opening and cleaning cotton tufts from bales of cotton is the generation of fine trash and dust that contaminate the surrounding atmosphere. Many improvements have been made over the years to develop high quality yarns in a dust free atmosphere. Efforts to reduce atmospheric dust surrounding the opening and cleaning process for cotton have been successful to the extent of capturing the dirty air constituting the environment, cleaning the dirty air, and recycling the cleaned air into the textile mill. Such cleaning methods are efficient and useful but fail to remove any fine trash and dust that remain with the cotton fibers. The remaining fine trash and dust are thus carried with the fibers into the carding process. Further atmospheric contamination occurs as fine trash and dust are released in the carding process for cotton fiber. This atmospheric contamination by fine particles is now subject to strict standards either established or being established through the Occupational Safety and Health Act of 1970.

Some opening and cleaning machines in a processing line produce cotton that has been opened to a high degree and discharges the opened cotton mixed with fine trash and dust at a high velocity to the next step in the cotton processing line. As stated above, there have been numerous techniques to clean the dirty air associated with the opening and cleaning process, however, no prior art thus far addresses the problem of removal of the fine trash and dust directly associated with cotton opened to a high degree by opening and cleaning machinery.

SUMMARY OF THE INVENTION

The instant invention discloses an apparatus to extract fine dust and trash from cotton fiber and comprises in combination the following: a rotating cylinder with a surface containing a plurality of perforations. These perforations are sized large enough to allow the passage of fine dust and trash particles but small enough to retain the cotton fiber tufts on the surface of the cylinder. There is a stationary conduit juxtaposed co-axially inside the rotating cylinder and one side of the conduit is opened to receive the fine dust and trash particles which pass through the perforations of the rotating cylinder. This stationary conduit also provides a bearing support for the rotating cylinder. Adjacent to the opening in the stationary conduit is provided a means of feeding the fine dust, trash and cotton fiber tufts onto the rotating cylinder. Means for removing the cotton fiber from the surface of the rotating cylinder is provided downstream of the feeding means. Thus as the fine trash and dust are fed onto the rotating cylinder with the cotton fiber tufts, the fine dust and trash particles pass through the perforations in the rotating cylinder as the cotton fiber tufts remain on the surface of the rotating cylinder. The fine dust and trash pass through the opening in the stationary conduit and the cotton fiber tufts rotate downstream where they are removed from the rotating cylinder.

DESCRIPTION OF THE PREFERRED EMBODIMENTS

The instant invention consists of separating fine trash and dust from cotton fiber tufts discharged from an opening and cleaning machine by passage of the fine trash and dust particles through small openings on the surface of a perforated revolving cylinder drum opposite the discharge exit of the opening and cleaning machine. Several critical parameters must be used to accomplish separation of fiber from fine trash and dust. First, the surface rotation velocity of the perforated drum must be no less than the discharge velocity of the fiber trash and dust which is existing from the opening and cleaning machine in order to achieve maximum separation. Secondly, the alternate airflow velocity within the tube located inside the perforated drum must be equal to or greater than the velocity of fiber, dust and trash being discharged by the opening and cleaning machine. Thirdly, airflow conveying cotton fiber to subsequent processing steps must be lower in pressure than the airflow of discharging the cotton, fine trash and dust coming from the opening and cleaning machine.

Figure 1:
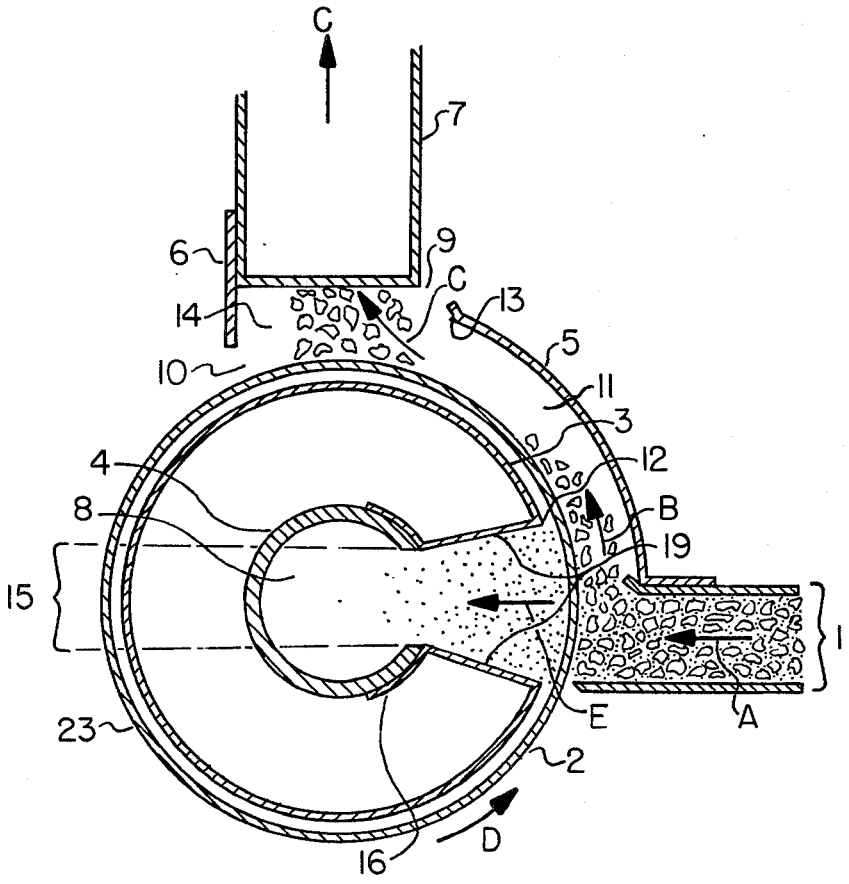
FIG. 1 is a schematic side view of the dust extractor and illustrates the separation of fine trash and dust from cotton fiber.

Referring now to FIG. 1, cotton fiber tufts, fine trash and dust come from the opening and cleaning machine (not shown) through exit 1 in direction of arrow A onto a rotating external perforating cylinder/drum surface 2. The perforations in the cylinder/drum are sized large enough to allow the passage of the fine dust and trash particles but small enough to retain the cotton fiber tufts on the surface of the rotating cylinder. There is a stationary conduit/tube 4 which is juxtaposed co-axially inside rotating cylinder 23 and one side of conduit 4 is opened to receive the fine dust and trash particles which pass through perforations 17 (FIG. 2), of rotating cylinder 23. The stationary conduit 4 also provides bearing support for rotating cylinder 23. Adjacent to this opening in conduit 4 is provided a means 1 of feeding the fine dust, trash and cotton onto revolving cylinder 23. The distance traversed from the discharge exit to surface 2 of cylinder 23 is critical in that the discharge air must be sufficient to project the mixture of fiber, trash and dust; if the distance is too large, the discharge rate will drop significantly and impair the effectiveness of the instant invention. Therefore, the instant invention must be located close enough to the discharge of the opening and cleaning machine so that the cotton fiber is deposited on rotating perforated surface 2 and carried in the direction of arrow B on rotating drum 23 through atmospheric pressure in zone 11, located between points 12 and 13. Zone 11 is one of the three most critical elements of the instant invention as the pressure of this zone must be no less than the pressure at discharge exit 1 of the opening and cleaning machine so that the trash and dust will exit through the perforated surface 2 instead of entering zone 11. A pressure drop occurs near surface 2 of the perforated rotating drum due to a low pressure area 8 inside tube 4. Drum 23 rotates in the direction of arrow D, about open-end stationary conduit tube 4 wherein a low pressure in area 8 is created by a suction device (not shown). A pressure drop, or suction created near perforated surface 2 pulls fine trash and dust through perforations 17, FIG. 2, into low pressure area 8, FIG. 1, located within tube 4 where the fine dust and trash is discharged into a filter (not shown). At the same time the larger fiber tufts remain on surface 2 of rotating drum cylinder 23 and are carried through zone 11 and subsequently sucked up through zone 14. Pressure in zone 8 must be significantly less than pressure at discharge exit 1 and zone 11 so that fine trash and dust will be extracted through zone 8 and not carried with cotton fiber thru zone 11 and into low pressure zone 14. Zone 14 is a low pressure area created by suction from cotton fiber intake duct 7. Pressure in zone 11 is controlled by openings 9 and 10 that allow outside air at atmospheric pressure to flow into zone 14. In low pressure zone 14 cotton fibers are lifted from rotating drum surface 2 by means of air entering at openings 9 and 10 then entering into intake duct 7 which is a pneumatic means for removing the cotton tufts in the direction of arrow C. Curved adjustable baffle 5 and flat baffle 6 are employed to adjust the size of the openings 9 and 10 respectively, thereby controlling the velocity of air into low pressure zone 14, said air acting as fiber conveying air and thus assuring atmospheric pressure in zone 11. Curved adjustable baffle 5 is located co-axially to rotating cylinder 23 and stationary tube 4. Flat baffle 6 is parallel to attached intake duct 7. Curved adjustable baffle 5 is attached on one end to pneumatic feeding means 1.

Figure 2:
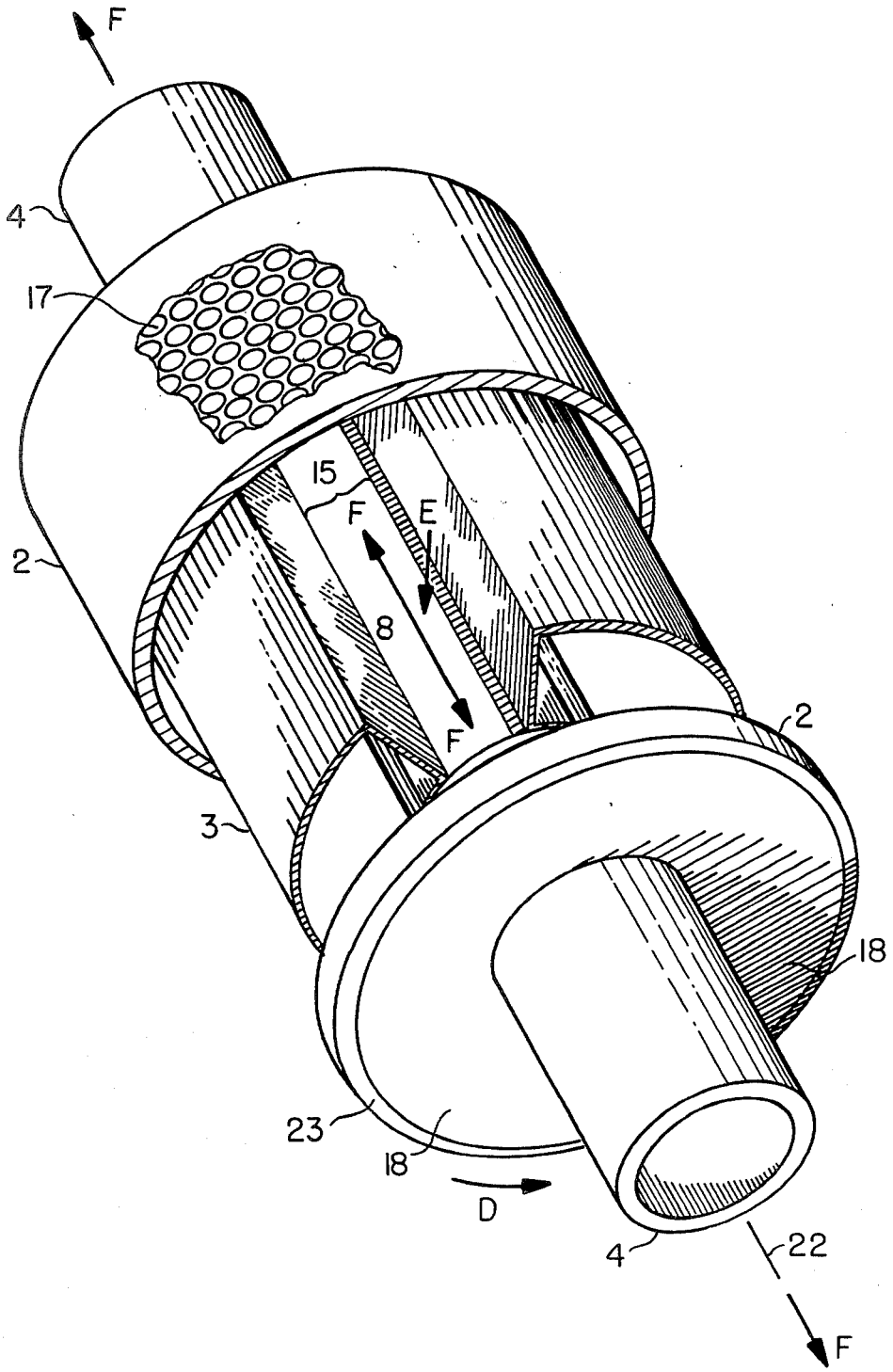
FIG. 2 is a cut away isometric view of the instant invention showing the exposed internal elements and the perforated surface.

Simultaneously during the above described process for separating the cotton fiber from fine dust and trash, fine dust and trash go through perforations 17, FIG. 2, in drum surface 2 as shown by directional arrow E into low pressure zone 8 of tube 4. An internal cylindrical baffle 3, FIG. 2, co-axially located between rotational cylinder 23 and stationary tube or conduit 4 is attached to open-end stationary tube 4 by tabs 16. The baffle is located between stationary tube 4 and perforated cylinder 23, FIG. 1. Baffle 3 has ends 19 which run parallel and perpendicular to opening 15 in the stationary open-end tube 4, FIGS. 1 and 2, and isolates this area within rotating perforated drum 23, FIG. 1. The area of opening 15 corresponds and is opposite or adjacent to discharge exit 1, FIG. 1, and assures directional flow E of fine dust and trash toward opening 15 in tube 4 formed by ends 19 and maintains low pressure area 8. A vacuum system (not shown) is attached to both ends of stationary tube 4, FIG. 2, to provide a high velocity airflow in the direction of arrow F. This carries suction of air through opening 15, as shown by directional arrow E, and through perforated drum 23, FIG. 1. The suction or airflow, as shown by arrows F and E in stationary tube 4 carries the fine dust and trash out and into a conventional waste removal system (not shown).

Referring now to FIG. 2, surface 2 of perforated drum 23 consists of a sheet of perforated material, a section of which is shown, 17, FIG. 2 around end plate 18, allowing perforated drum 23 to rotate freely in the direction of arrow D around stationary tube 4 on axis 22. Rotating drum 23 is driven by any conventional means (not shown). Drum surface velocities slower than the discharge velocity of fine dust and trash will create a clogging of cotton fibers on the perforated surface, thereby reducing and eventually stopping the removal of dust and fine trash. Higher drum surface velocities will also reduce removal of dust and fine trash, therefore, it is preferable to maintain drum surface velocity that equals the discharge velocity at exit 1.

The diameter of perforated holes 17 on the cylindrical surface is 0.117". These holes occupy 51% of the total surface area that is exposed to stationary tube opening 15, FIG. 2, during drum rotation, arrow D. The diameter of the perforations is critical to prevent passage of cotton fiber through the perforated drum surface 2 but still allow passage of dust and fine trash.

Open end stationary tube 4, FIG. 2, is held in the position shown in FIG. 1 by split circular clamps (not shown) mounted outside of a bearing 20 not shown. In turn, said split circular clamps are attached to a base for the apparatus (not shown).

In operation the following example illustrates the results achieved by the instant invention:

EXAMPLE 1

Two blends of cotton, called Cotton A and Cotton B, were processed through an opening and cleaning line to produce 14 oz/yd finisher laps. These laps were produced with and without the dust extractor apparatus of the instant invention attached to an opening and cleaning machine. Fiber discharge conditions of this machine were 1000 cubic feet per minute (CFM) at a velocity of 2000 feet per minute (FPM). The intake of a blower was connected to both ends of the stationary open end tube 4 and provided an air displacement of 1000 cubic feet per minute within the tube 4 end assembly. The perforated drum (12" in diameter) rotated at a velocity of 2000 feet per minute. Three laps were used per test in evaluating the effectiveness of the apparatus of the instant invention. The laps were continuously carded in an experimental carding room and the dust level was allowed to stabilize before dust measurements were taken with a vertical elutriator and a personal sampler. The reduction of card room dust level is shown in the following table to demonstrate the effectiveness of the apparatus of the instant invention.

TABLE I

| | % Dust Reduction | |
|---|---|---|
| Measuring Device | Cotton A | Cotton B |
| Personal sampler | 21 | 22 |
| Vertical elutriator | 17 | 26 |

These values were significant at the 95% level.

We claim:

1. An apparatus to extract fine dust and trash from cotton fiber comprising in combination:

(a) a rotating cylinder with a plurality of perforations through the surface, said perforations sized for the retention of the cotton fiber tufts on the surface thereof;

(b) a stationary conduit juxtaposed co-axially inside said rotating cylinder, said stationary conduit opened on one side thereof to receive fine dust and trash as it passes through the perforations of said rotating cylinder, said conduit also providing bearing support for said rotating cylinder;

(c) an internal baffle juxaposed co-axially between the rotating cylinder and stationary conduit, said baffle opened on the same side and corresponding to the opening of the stationary conduit;

(d) a pneumatic system for feeding the cotton fiber, fine dust and trash onto the rotating cylinder, said feeding means adjacent to said opening in said stationary conduit;

(e) a pneumatic removal means adjacent to the rotating cylinder to remove the cotton fiber from the surface of the cylinder working in combination with a flat adjustable baffle which is attached on one end and parallel to the pneumatic removal means, said flat adjustable baffle adjusted to form an opening between the end thereof and the rotating cylinder, said opening allowing a flow of outside air at atmospheric pressure into the apparatus to a low pressure zone between the pneumatic removal means and the rotating cylinder thus assisting the pneumatic removal means in lifting the cotton fiber from the surface of the rotating cylinder; a curved adjustable baffle attached on one end to the pneumatic feeding means, juxtaposed co-axially to the external cylindrical surface of the rotating cylinder and adjusted to form an opening betwen the pneumatic removal means and the end of the curved baffle, said opening allowing outside air at atmospheric pressure to flow into the apparatus to the low pressure zone between the pneumatic removal means and the rotating cylinder thus assisting the pneumatic removal means in lifting off the cotton fiber from the surface of the rotating cylinder; and (f) a pneumatic removing means for removing the fine dust and trash from the stationary conduit.

2. The apparatus of claim 1 including end pieces connecting the opening of the stationary conduit and the opening of the internal cylindrical baffle, thus forming an enclosure between the internal baffle and the stationary conduit.

3. The apparatus of claim 1 further including connecting tabs for attaching the internal baffle to the surface of the stationary conduit.

* * * * *